United States Patent [19]

Chiron et al.

[11] 4,235,188

[45] Nov. 25, 1980

[54] ADJUSTMENT OF THE QUANTITY OF IMPREGNATING OR COATING MATERIAL

[75] Inventors: Georges Chiron; Maurice R. Giles, both of Chambery, France

[73] Assignee: Saint-Gobain Industries, Neuilly-sur-Seine, France

[21] Appl. No.: 36,056

[22] Filed: May 4, 1979

Related U.S. Application Data

[62] Division of Ser. No. 862,502, Dec. 20, 1977, Pat. No. 4,189,506.

[30] Foreign Application Priority Data

Dec. 21, 1976 [FR] France ..... 76 38465

[51] Int. Cl.[2] ..... B05C 3/172

[52] U.S. Cl. ..... 118/101; 118/120; 118/121; 118/123

[58] Field of Search ..... 118/101, 121, 122, 123

[56] References Cited

U.S. PATENT DOCUMENTS

| | | | |
|---|---|---|---|
| 2,717,215 | 9/1955 | Faulkner | 427/177 |
| 3,470,848 | 10/1969 | Dreher | 118/410 |
| 3,910,230 | 10/1975 | Mercer | 118/122 X |

FOREIGN PATENT DOCUMENTS

| | | |
|---|---|---|
| 2226217 | 11/1974 | France . |
| 547717 | 9/1942 | United Kingdom . |
| 600687 | 4/1948 | United Kingdom . |
| 933664 | 8/1963 | United Kingdom . |
| 1036770 | 7/1966 | United Kingdom . |
| 1090877 | 11/1967 | United Kingdom . |

*Primary Examiner*—James R. Hoffman

*Attorney, Agent, or Firm*—John T. Synnestvedt; Charles H. Lindrooth

[57] ABSTRACT

Method and apparatus for controlling and particularly for reducing the retention rates of viscous impregnate or coating materials on fibers, strands or textile ribbons are disclosed. The impregnated or coated material is submitted to successions of compressions and decompressions. Drainage of the viscous material is effected in the decompression intervals which separate the compression intervals.

10 Claims, 5 Drawing Figures

ADJUSTMENT OF THE QUANTITY OF IMPREGNATING OR COATING MATERIAL

This is a division of application Ser. No. 862,502, filed Dec. 20, 1977, now U.S. Pat. No. 4,189,506.

BACKGROUND AND THE PRIOR ART

In numerous applications it is necessary to impregnate or coat linear shaped materials, such as fibers, strands or textile ribbons, particularly mineral fibers such as glass fibers, with a viscous matter, such as synthetic resin.

Generally it is necessary that this deposit of matter be regularly distributed and thus the quanity of matter retained by the material must be adjusted. It is known, in order to make this adjustment, to force the impregnated materials through dies. This method of adjustment has various inconveniences.

The principal inconvenience with this method is that it does not obtain retention rates below 25% of the total mass of material and deposit. Depending on the speed of operation, the retention rate may be between 25 and 30% and it seems impossible, even when using small dies to go below these values.

SUMMARY AND OBJECTS OF THE INVENTION

The invention proposes to formulate a method for the obtainment of retention rates much below these limits, for example, on the order of 15 to 20%.

According to the method of the invention, the impregnated linear material is forced through a zone where is it submitted to a succession of compressions and decompressions causing a plastic deformation of the viscous matter; this method is, in addition, characterized in that the plastic flow of the viscous matter is slowed down in the direction of the movement of the linear material while this material is submitted to a series of compressions at close intervals, and characterized in that the viscous matter thus pressed is drained and gathered during the decompression interval which separates each compression interval from the succeeding one.

According to another characteristic of this invention, the first and last compressions are carried out in two directions —perpendicular simultaneously to each other and to the direction of movement of the material.

With this method one of the two compression directions is vertical with respect to the other.

According to another characteristic of the invention, each intermediate compression between the first and the last compression is carried out in one common direction perpendicular to the direction of the movement of the material.

With this method the common direction of the intermediate compression is vertical.

According to another characteristic of the invention, the drainage of the pressed viscous matter takes place substantially perpendicular to the direction of movement of the linear material.

With this method the drained viscous matter is continuously gathered.

An object of the invention, likewise is an apparatus for the use of the above defined method.

This apparatus is characterized in that it comprises compression means at close intervals and in alignment with each other, including an entrance orifice, at least one calibrated space bordered by two flat sides facing one another and an exit orifice, which compress the impregnated linear material at the time of its passage, and comprises decompression means which are between the compression means and transversely oriented with relation to the direction of the entrance orifice—exit orifice and which assure drainage and evacuation of the excess viscous matter.

Other characteristics and advantages of the invention will become apparent from the description which follows and which refers to a form of embodiment of an apparatus according to the invention, this form of embodiment being given as an unlimited example.

DESCRIPTION OF THE DRAWINGS

In this description the attached drawings are referred to, which show.

DESCRIPTION OF THE PREFERRED EMBODIMENT

Figure 1:
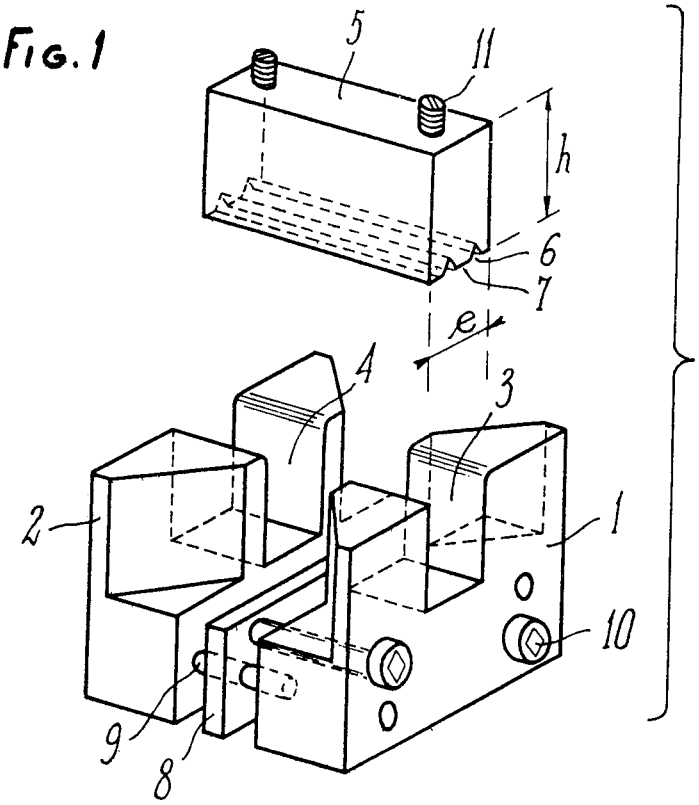
FIG. 1 an exploded view in perspective of the assembly of the invention.

In the form of embodiment illustrated in FIG. 1, the apparatus according to the invention comprises one element composed of two identical parts 1 and 2 substantially "U"-shaped cut out through the middle and thus forming grooves 3 and 4.

The second component of the apparatus is a parallelepipedal block 5 whose thickness e is slightly less than the width of the grooves 3 and 4 and whose height h corresponds for the most part to the height of the said grooves.

On one surface of the block 5 are longitudinal grooves 6, this surface thus containing the flat parts 7 separated from each other by the grooves 6. As a means of unlimited example, it is pointed out that for a block 5 of a thickness e=12 mm, two grooves 6 of width equal to 3 mm are provided, the width of the flat parts 7 being 2 mm.

Figure 2:
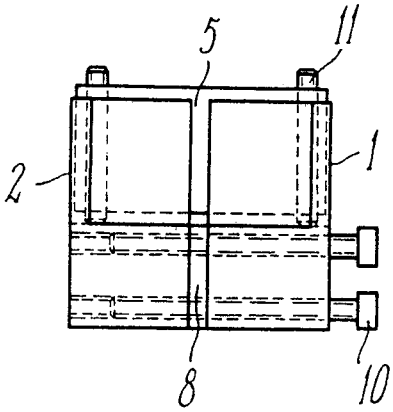
FIG. 2 a side view of the apparatus after assembly.
Figure 3:
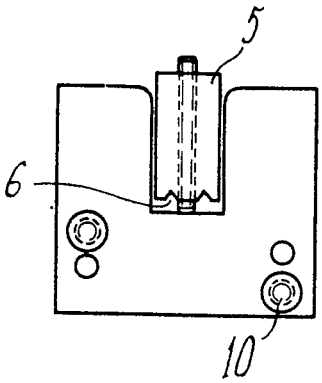
FIG. 3 a structural view referring to FIG. 2.

The mounting of the apparatus is effected by having the block 5 inserted in the grooves 3 and 4 of the first element after a plate 8 is placed between the parts 1 and 2, the plate being fixed by the threaded gudgeons 9 having heads 10 (FIG. 2). The block 5 is itself traversed by the threaded rods 11, the ends of which come to rest on the bottom surface of the grooves 3 and 4, this device permitting control of the height of the entrance and exit orifices (FIG. 3). The width of these orifices is itself determined by the thickness of the plate 8.

In the form of embodiment illustrated in FIGS. 1 to 3, the entrance and exit orifices have rectangular shapes with the large and small sides comprising the width and the height respectively of these orifices. In addition, the length of the small side of the rectangle is equal to t the distance separating the two flat sides which border each calibrated space.

The apparatus described above easily permits the introduction of linear material into the entrance and exit orifices and into the calibrated spaces when the block 5 is retracted from the grooves 3 and 4. In addition, the parts 1, 2 and 8 of the first element and the block 5 of the second element do not present any overlapping zone in contact with the linear material which could possible unravel this material when working the process.

As shown above, with this apparatus the materials between the two elements are submitted to compressions when they pass between the upper edge of the plate 8 and the flat parts of the element 5, and to decompressions when they pass through the region facing the grooves 6, the excess impregnation or coating material being eliminated by these grooves.

The ensemble of the apparatus which has just been described is fixed in a block which assures, on one hand, the cohesion of the elements 1, 2 and 5, and, on the other hand, the possible heating of the ensemble in order to permit adjustment of the viscosity of the impregnation or coating material.

Figure 4:
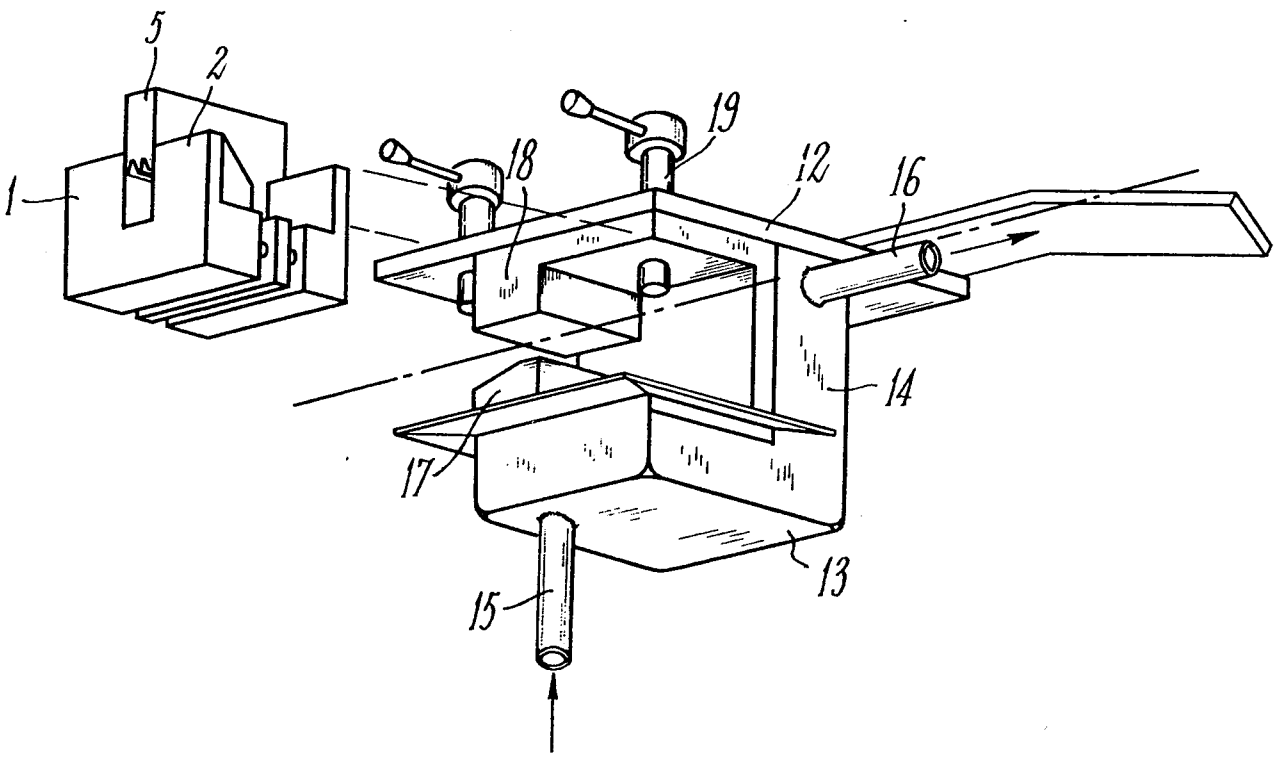
FIG. 4 an exploded view in perspective of the apparatus and of the part responsible for its maintenance and heating.

Such a block, illustrated in FIG. 4, is in the shape of a vise, one of the chops of which is the plate 12 in which a threaded rod 19 is screwed, and the other chop of which is comprised of a hollow piece 13. The part 14 connecting the two chops is itself hollow and a hot fluid led by a tube 15 and leaving by a tube 16 assures the heating of the block.

The two elements of the apparatus according to the invention are introduced between the plate 12 and the hollow piece 13, their placement and maintenance being assured by the guides 17–18. The tightening into the block is obtained by means of the threaded rod 19.

Figure 5:
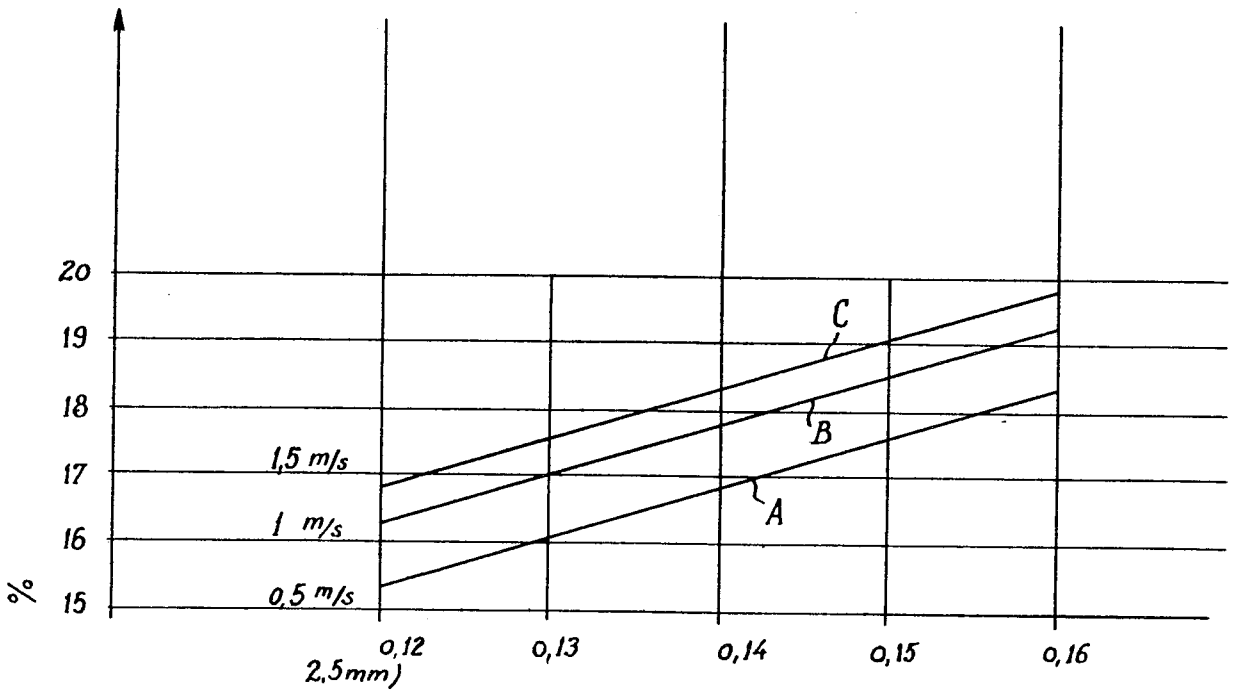
FIG. 5 a family of curves illustrating the results obtained with the invention.

The curves of FIG. 5 illustrate the results procured by the invention. They illustrate the resin retention rates as a function of the height of the entrance orifice at a resin bath temperature of 80° C., the width of the orifice being constant and equal to 2.5 mm.

As a means of unlimited example, the resin bath may be comprised of:

100 parts in weight of liquid epoxy resin (Ref. LY556 from CIBA), and 3 parts in weight of boric trifluoride.

The viscosity at 80° C. of such a mixture is near 3 poises.

The curves A, B, C correspond to the speeds of passage of the material of 0.5 m/sec, 1 m/sec and 1.5 m/sec respectively.

It will be noted, as a result of the invention, that for viscosities between 1 and 5 poises, impregnation rates display values (15 to 20%), in relation to the total mass, clearly below those obtained with the help of the standard drying methods (25 to 35%). Examination of the curves show that the resin retention rates increase with the speed of passage of the linear materials.

We claim:

1. Apparatus for adjusting the quantity of viscous matter for impregnating or coating linear material such as strand or textile ribbon, characterized in that it comprises compression means containing an entrance orifice, at least one calibrated spaced bordered by two flat surfaces facing each other, and an exit orifice, all at close intervals and in alignment with each other and which compress the impregnated linear material during its passage, and further comprises decompression means between the compression means which are transversely oriented in relation to the direction of the entrance orifice—exit orifice and which assure drainage and evacuation of the pressed viscous material.

2. Apparatus according to claim 1, characterized in that the entrance orifice is rectangular.

3. Apparatus according to claim 2, characterized in that the exit orifice has the same rectangular cross section as the entrance orifice.

4. Apparatus according to claim 3, characterized in that the distance separating the two flat surfaces which border each calibrated space is equal to the length of the smaller side of the rectangular entrance orifice.

5. Apparatus according to claim 4, characterized in that the decompression means are comprised of channels or grooves in which the viscous matter flows.

6. Apparatus according to claim 5, said apparatus being characterized in that it comprises a first component having two pairs of spaced apart parallel sides forming side boundaries of said entrance and exit orifices and a spacer between said pairs having a first flat surface separating the parallel sides and extending from one pair to the other, a second component having a flat surface facing the flat surface of said spacer, drainage channels in said flat surface of said second component extending transversely of said entrance and exit orifices and forming with said first flat surface the compression and decompression zones.

7. Apparatus according to claim 6, characterized in that said first component has a "U" shaped profile whose bottom and interior sides are flat when viewed from the entrance orifice, a rectilinear passage cutting the two sides transversely towards the bottom of the "U", further characterized in that said second component fits within the rectilinear passage with the drainage channels in the second component facing the bottom of the rectilinear passage and extending transversely to the sides of the "U".

8. Apparatus according to claim 7 further comprising an adjusting screw for setting the second component apart from the first component, said adjusting screw allowing control of the height of the exit and entrance orifices.

9. Apparatus according to claim 8, characterized in that the first component in a "U" shape is cut into two identical parts along a plane parallel to the two sides of the "U", means fixing said two parts to each other, an insert spacer plate placed in between said parts, the thickness of said spacer plate determining the width of the entrance and exit orifices.

10. Apparatus according to any of claims 6, 8 and 9, further comprising means for keeping these components in one piece, said means comprising a vise having internal passages traversed by a hot liquid whereby heat is supplied to said components.

* * * * *